US012152483B2

(12) United States Patent
Achalpurkar et al.

(10) Patent No.: US 12,152,483 B2
(45) Date of Patent: Nov. 26, 2024

(54) RESIN SEALED SENSOR PORT

(71) Applicant: HALLIBURTON ENERGY SERVICES, INC., Houston, TX (US)

(72) Inventors: Manojkumar Prakash Achalpurkar, Al Khobar (SA); Ping Chew Chay, Al Khobar (SA); Ibrahim El Mallawany, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 353 days.

(21) Appl. No.: 17/635,789

(22) PCT Filed: Jan. 3, 2020

(86) PCT No.: PCT/US2019/052862

§ 371 (c)(1),
(2) Date: Feb. 16, 2022

(87) PCT Pub. No.: WO2021/137843

PCT Pub. Date: Jul. 8, 2021

(65) Prior Publication Data

US 2022/0298912 A1 Sep. 22, 2022

(51) Int. Cl.

| | |
|---|---|
| ***E21B 47/017*** | (2012.01) |
| ***E21B 17/02*** | (2006.01) |
| ***E21B 47/06*** | (2012.01) |

(52) U.S. Cl.

CPC ..... *E21B 47/017* (2020.05); *E21B 17/028* (2013.01); *E21B 47/06* (2013.01)

(58) Field of Classification Search

CPC ..... E21B 47/017; E21B 17/028; E21B 47/06; E21B 17/02; E21B 47/01; E21B 47/07

(Continued)

(56) References Cited

U.S. PATENT DOCUMENTS 5,869,766 A * 2/1999 Cucci ..... G01L 19/0038 73/756
6,076,409 A * 6/2000 Bang ..... G01L 19/0038 73/756

(Continued)

FOREIGN PATENT DOCUMENTS

JP 7251440 B2 * 4/2023
RU 2652403 C1 * 4/2018

(Continued)

OTHER PUBLICATIONS

Examination Report; Great Britain Application No. 2202429.3; mailed Mar. 11, 2024.

(Continued)

*Primary Examiner* — Robert R Raevis
(74) *Attorney, Agent, or Firm* — NOVAK DRUCE CARROLL LLP

(57) ABSTRACT

An array of sensors provided on the outside of a tubular string for measuring a property within the tubular string. The array of sensors may include a plurality of connected sensors, wherein at least one of the plurality of connected sensors is at least partially encompassed in a shroud. A snorkel line may extend from the shroud, the snorkel line capable of coupling with a sensor port in a tubular of the tubular string. The snorkel line may establish fluid communication between one of the sensors at least partially encompassed in the shroud and a corresponding sensor port of a tubular in the tubular string.

20 Claims, 11 Drawing Sheets

(58) Field of Classification Search
USPC ... 73/431, 152.27, 152.51, 170.33, 299–303, 73/756; 374/137, 142, 143, 208, 209; 175/40, 50; 166/250.01, 250.03, 250.07
See application file for complete search history.

(56) References Cited

U.S. PATENT DOCUMENTS

| | | | |
|---|---|---|---|
| 2009/0078427 | A1 | 3/2009 | Patel |
| 2009/0160047 | A1 | 6/2009 | Otsuka et al. |
| 2012/0188846 | A1 | 7/2012 | Loi et al. |
| 2014/0367084 | A1 | 12/2014 | Richards et al. |
| 2018/0171797 | A1 | 6/2018 | Lembcke et al. |

FOREIGN PATENT DOCUMENTS

| | | | | | |
|---|---|---|---|---|---|
| WO | 2016028291 | A1 | | 2/2016 | |
| WO | 2016168564 | A1 | | 10/2016 | |
| WO | 2018160328 | A1 | | 9/2018 | |
| WO | 2018160340 | A1 | | 9/2018 | |
| WO | WO-2018160347 | A1 | * | 9/2018 | ..... E21B 33/12 |
| WO | WO-2019232052 | A1 | * | 12/2019 | ..... E21B 33/06 |

OTHER PUBLICATIONS

International Search Report and Written Opinion for International application No. PCT/US2019/052862, mailed Jun. 23, 2020, 12 pages.

* cited by examiner

RESIN SEALED SENSOR PORT

CROSS-REFERENCE TO RELATED APPLICATIONS

This application is a national stage entry of PCT/US2019/052862 filed Jan. 3, 2020, said application is expressly incorporated herein in its entirety.

TECHNICAL FIELD

The present technology is directed to systems and methods operable to create a sealed protective shell for downhole sensors for measuring fluid properties. In particular, the present technology involves sealing a sensor port to shield sensors from an external environment while allowing for determining various downhole properties.

BACKGROUND

Wellbore completion involves preparing a well for hydrocarbon production after drilling operations have been conducted. During this phase production tubing may be provided downhole for injecting various fluids or withdrawing hydrocarbon. Stimulation processes may have also been conducted including creating fractures in the formation. During these completion processes packers may be provided to isolate various zones along the length of the tubing and wellbore. These zones may isolate particular areas to facilitate production of hydrocarbon from the fractured portions of the formation.

During the completion phases, it is desirable to measure properties of the fluid, formation or tubing. Accordingly sensors may be provided downhole at various points of the tubing to collect data for processing.

BRIEF DESCRIPTION OF THE DRAWINGS

The instances herein may be better understood by referring to the following description in conjunction with the accompanying drawings in which like reference numerals indicate analogous, identical, or functionally similar elements. Understanding that these drawings depict only exemplary instances of the disclosure and are not therefore to be considered to be limiting of its scope, the principles herein are described and explained with additional specificity and detail through the use of the accompanying drawings in which.

DETAILED DESCRIPTION

Figure 1:
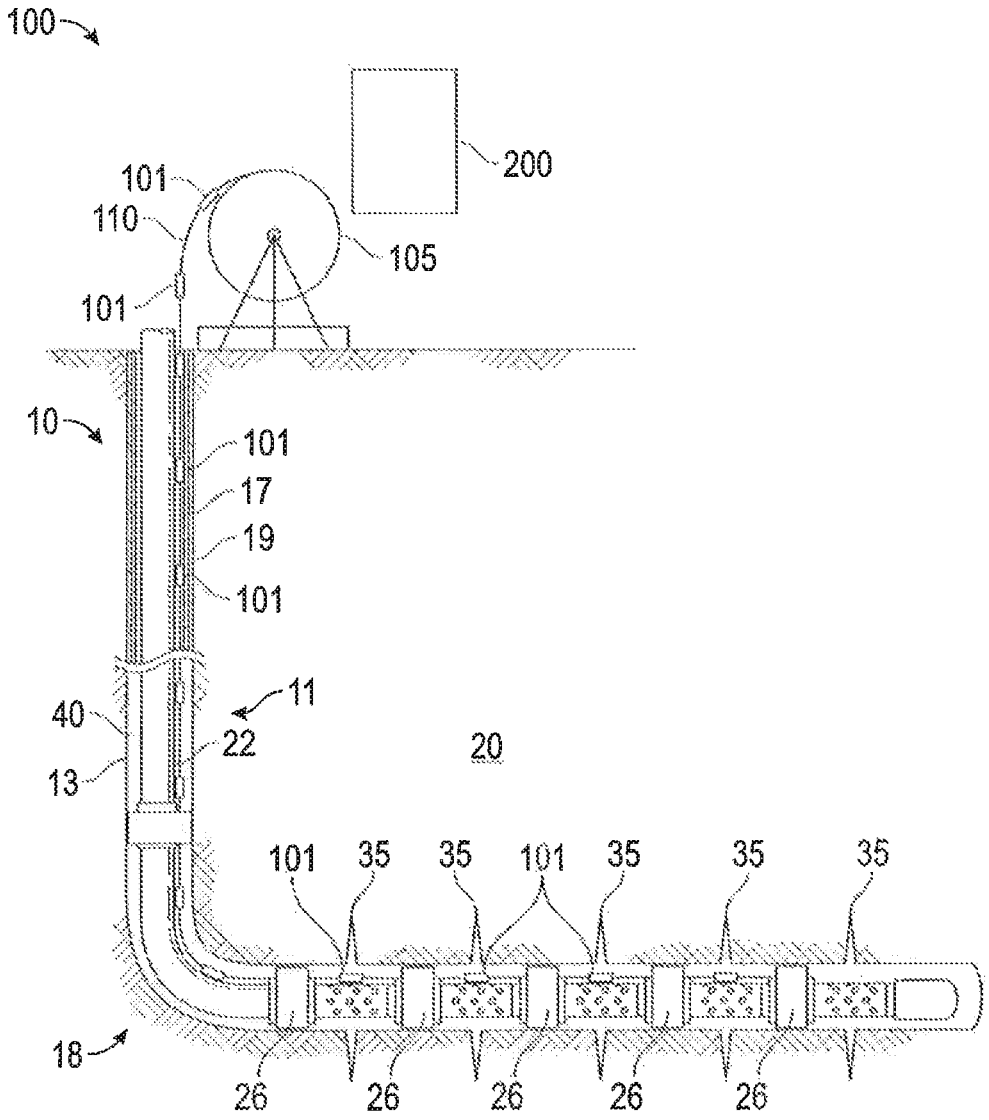
FIG. 1 is a schematic diagram of a tubular string provided in a wellbore for completion processes.

Various instances of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

As used herein, the term "coupled" is defined as connected, whether directly or indirectly through intervening components, and is not necessarily limited to physical connections. The terms "communicatively coupled" or fluidically coupled encompass establishing fluid communication of a fluid such as gas, liquids, hydrocarbons, borehole fluids and the like. The connection can be such that the objects are permanently connected or releasably connected.

Overview

The present disclosure provides for a system and method of sealing a shroud and/or snorkel providing fluid communication from a sensor to a sensor port in a tubular of a tubular string. The tubular string may have a collar provided along its length and covering the sensor port. The collar may itself have a collar port which aligns and/or fluidically communicates with the sensor port in the tubular. The collar may have a seat and/or other coupling for receiving a connector, such as a ferrule type tubing connector, so as to provide a sealed coupling. The connector can provide a sealing engagement (e.g., sealing coupling) with a snorkel extending from the sensor in a sensor array external the tubular. The sensor may be encompassed by a shroud, which may be elastomeric and/or rigid, and may provide a chamber for the sensor. The snorkel can have a fluid channel extending from the connector to within the shroud, thereby providing a fluid communication channel extending from a central flow passage of a tubular through the collar, the connector, and the snorkel to the sensor. Accordingly, temperature, pressure, and/or other fluidic properties within the tubular can be measured.

The shroud and/or snorkel may be sealed with an external resin coating either pre-applied (e.g., before the tubular is spooled and transported to a well site) and/or applied on-site (e.g., as the tubular is unspooled and prior to running into hole). The resin may also be applied internally to the shroud to provide a water- and air-tight seal between sections of the shroud and snorkel.

Accordingly, the present disclosure enables the ability to seal a protected and ported sensor array without performing operations on a tubing encased conductor ("TEC") or other conductive line including, but not limited to, welding and splicing, or make up electrical connections. The resin can allow for sealing a shroud protecting a snorkel line, while providing for flexibility of the snorkel line so that there is no requirement to be exact as to where the sensor falls in a completion—it may just be ported to the closest coupling or dedicated port above or below.

Furthermore, the system and method of sealing a shroud and snorkel disclosed herein can facilitate easy preparation by service providers on the surface deploying the tubular string and the protected array of sensors.

DESCRIPTION

FIG. 1 is a schematic diagram depicting an environment in which aspects of the present disclosure may be implemented. As illustrated, the environment includes a completion 10. Although a completion is illustrated in FIG. 1, the present disclosure may be implemented in a well with no production, flow, or injection as well, and may operate equally as well without packers, isolated zones, as well as in alternative phases of a well which are not under completion. With respect to the instance shown in FIG. 1, the completion 10 includes a tubular string 22 for use in completion and stimulation of formation, and an annulus 40. The terms stimulation and injection, as used herein, can include fracking, acidizing, hydraulic work and other work-overs. The tubular string 22 may be made up of a number of individual tubulars, also referred to as sections or joints. The sections can include multiple tubulars assembled together, as well as blank tubing, perforated tubing, shrouds, joints, or any other sections as are known in the industry. Each of the tubulars of the tubular string 22 may have a central flow passage an internal fluid and an external surface. The phrase "tubular" may be defined as one or more types of connected tubulars as known in the art, and can include, but is not limited to, drill pipe, landing string, tubing, production tubing, jointed tubing, coiled tubing, casings, liners, or tools with a flow passage or other tubular structure, combinations thereof, or the like.

A wellbore 13 extends through various earth strata. Wellbore 13 has a substantially vertical section 11, the upper portion of which has installed therein casing 17 held in place by cement 19. Wellbore 13 also has a substantially deviated section 18, shown as horizontal, that extends through a hydrocarbon bearing subterranean formation 20. As illustrated, substantially horizontal section 18 of wellbore 13 is open hole. It is understood, however, that the wellbore may be cased or open, vertical, horizontal, deviated, or any other orientation.

Packers 26 straddle target zones of the formation. The packers 26 isolate the target zones for stimulation and production and which may have fractures 35. The packers 26 may be swellable packers. The packers 26 can also be other types of packers as are known in the industry, for example, slip-type, expandable or inflatable packers. Additional downhole tools or devices may also be included on the work string, such as valve assemblies, for example safety valves, inflow control devices, check valves, etc., as are known in the art. The tubing sections between the packers 26 may include sand screens to prevent the intake of particulate from the formation as hydrocarbons are withdrawn. Various suitable sand screens include wire mesh, wire wrap screens, perforated or slotted pipe, perforated shrouds, porous metal membranes, or other screens which permit the flow of desirable fluids such as hydrocarbons and filter out and prevent entry of undesirable particulates such as sand.

As shown, an array of sensors 100 can be spoolable from spool 105. The array of sensors 100 is shown as having a line 110 which connect each of the individual sensors 101. The line 110 may be a cord, line, metal, tubing encased conductor ("TEC"), fiber optic, and/or other material or construction, and may be conductive and permit power and data to transfer over the line 110 between each of the sensors 101 and to the surface. The line 110 may be sufficiently ductile to permit spooling and some amount of bending, but also sufficiently rigid to hold a particular shape in the absence of external force. Data from the array may be provided to one or more processors, such as device 200 discussed further below. While the array of sensors 100 can be provided within the annulus between tubular string 22 and casing 17, it within the scope of this disclosure to implement the array of sensors 100 in other arrangements including, but not limited to, on the outside of casing and within the cement 19 between casing 17 and/or wellbore surface or inside the production tubulars 22.

A completion can be divided into one or more production zones with the use of one or more packers. The production flow can come from the formation, and may pass through a screen, through a flow regulator (inflow control device (ICD), autonomous inflow control device (AICD), inflow control valve (ICV), choke, nozzle, baffle, restrictor, tube, valve, et cetera), and into the interior of the tubing.

Figure 2:
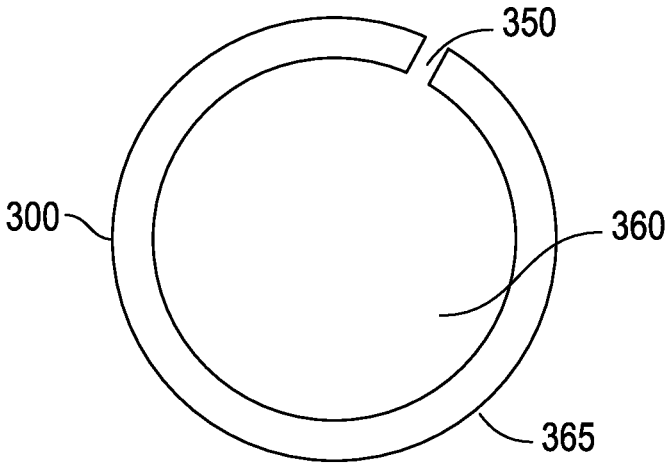
FIG. 2 is a sectional view of a tubular with a sensor port according to at least one instance of the present disclosure.

FIG. 2 is a cross-sectional view of a tubular 300 of a tubular string 22. The tubular 300 can have a central flow passage 360 formed therein. The tubular 300 can have a wall 352 having an external surface 365, with the wall 352 defining the central flow passage 360 therethrough. A sensor port 350 can be provided in the wall 352 extending from the external surface 365 to the central flow passage 360. In at least one instance, the sensor port 350 can be an aperture formed in the wall 352 providing fluidic communication with the central flow passage 360. In some instances, the sensor port 350 can have a collar, and/or mandrel coupled therewith and operable to couple the sensor port 350 with one or more sensors 100 (as described above with respect to FIG. 1).

Figure 3A:
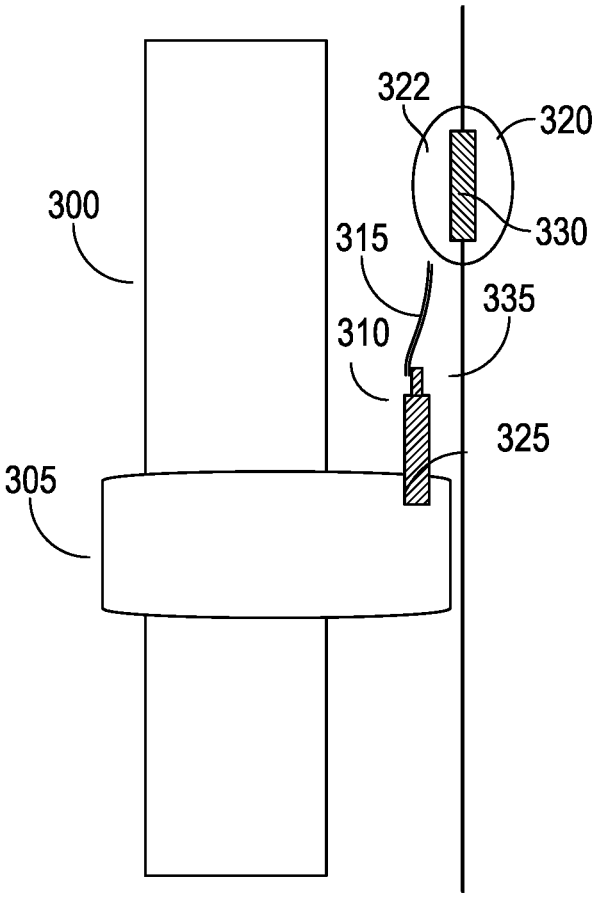
FIG. 3A is diagrammatic view of a sensor with a snorkel, and connector according to at least one instance of the present disclosure.

FIG. 3A is a diagrammatic view of a tubular 300 of a tubular string 22 having a collar 305 (or mandrel) received thereon, according to at least one instance of the present disclosure. The collar 305 can be an eccentric coupling having a seat 325 containing a connector 310. The connector 310 may be any fluidic sealed coupling. In at least one instance, the connector 310 may be a ferrule type tubing connector, and may also include couplings with a SWAGELOK™ fitting, National Pipe Thread (NPT), and/or other fitting.

The connector 310 can have couplings at opposing end, such as a male and/or a female connector, optionally threaded, and may contain seals operable for sealing engagement and coupling, and may provide for metal to metal sealing and coupling. The connector 310 may have an internal bore 326 running along its length, for passage of fluid (shown more clearly with respect to FIG. 3C). In at least one instance, commercially available connectors include an FMJ connector by Halliburton Energy Services, Inc. which permits a metal to metal seal. The connector 310 may be any of the connector sizes for fluidic coupling with the tubular—or could be other standard industry thread.

Figure 3B:
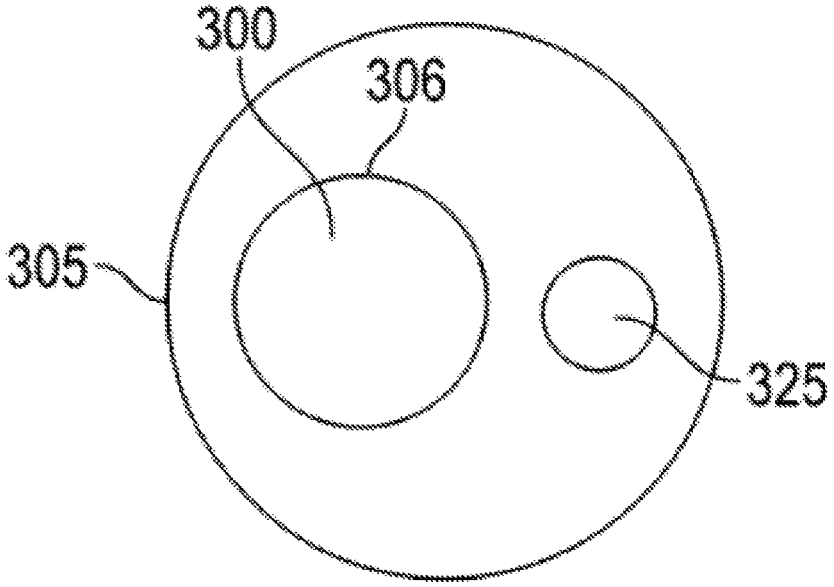
FIG. 3B is a sectional view of a collar according to at least one instance of the present disclosure.

FIG. 3B illustrates a cross-sectional view of a collar 305. The collar 305 can be a regular coupling, with an aperture ported to inside and a block welded over the hole with an FMJ connector port, or another port, in the block. The collar 305 can have an aperture 306 therethrough operable to receive at least a portion of a tubular 300 therein. The aperture 306 can be formed through one portion of the collar 305 and a seat 325 (or aperture) can be provided for receiving a connector in another portion of the collar 305.

Figure 3C:
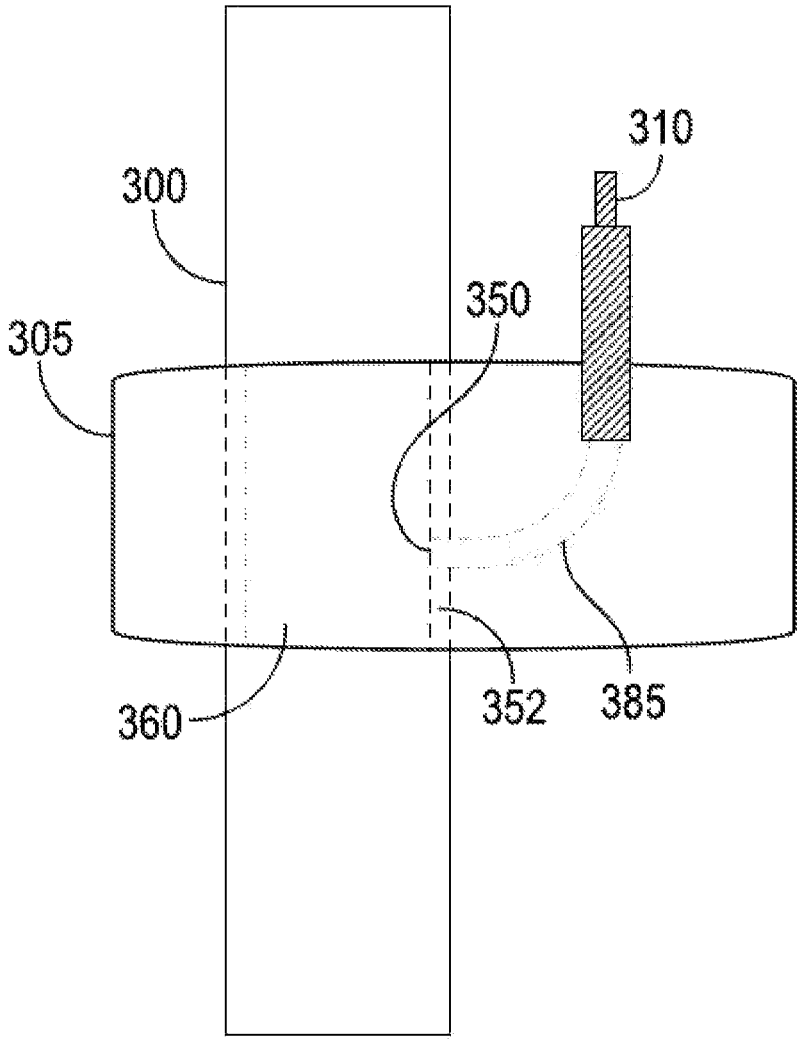
FIG. 3C is a diagrammatic view of a collar according to at least one instance of the present disclosure.

FIG. 3C is a diagrammatic view of a collar 305 coupled with tubular 300. The collar 305 may have a collar port 385 which may be a bore formed through the collar 305 and is communicatively coupled, establishing fluid communication, with the sensor port 350 of tubular 300. The sensor port 350 may extend through the wall 352 of the tubular 300, and into the central flow passage 360. While FIG. 3C illustrates the sensor port 350 formed within the tubular 300, the present disclosure provides any downhole tool, or tool with tubular structure, such as with an internal flow passage or cavity may be provided with a sensor port 350. In at least one instance, collar 305 and tubular 300 can be made as one piece.

Referring back to FIG. 3A, a single sensor system 328 (as part of an array of sensors) can be coupled with and communicatively engaged with the shroud 320. The shroud 320 can form a chamber 322 operable to receive at least a portion of a sensor 330. In at least one instance, the shroud 320 can form a chamber operable to receive the sensor 330 therein. In other instances, the shroud 320 can form a chamber 322 around one or more detector ports 340 of the sensor 330.

The shroud 320 may be elastomeric, rigid, and/or semi-rigid. The shroud 320 may be a clam shell type of housing that is installed at the rig floor level with an elastomeric, epoxy, swell rubber, and/or metallic type crush ring seal. The seal can prevent exposing the one or more detector ports 340 of the sensor 330 to environmental contamination.

The sensors 330 on the array of sensors can be temperature and/or pressure sensors. The sensor can be a resonance-based pressure sensor, or a strain-based pressure sensor. The resonance-based pressure sensor, like a quartz pressure sensors, measure the frequency change in an oscillator as the hydrostatic pressure changes. A strain-based pressure sensor measures the deflection of a structure due to a pressure differential between hydrostatic pressure and an air chamber. The sensors in the array of sensors may also measure other well parameters, including vibration, wellbore chemistry, or radioactivity among others.

Figure 3D:
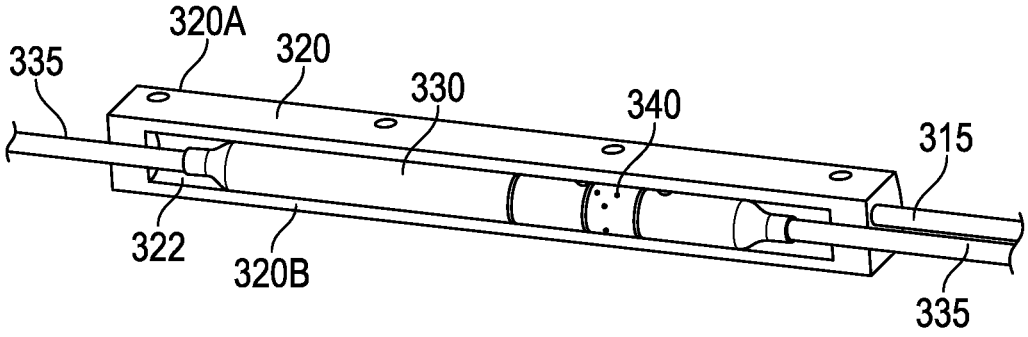
FIG. 3D is a cross-sectional isometric view of a shroud and snorkel having a ported sensor received therein according to at least one instance of the present disclosure.

FIG. 3D is a cross-section isometric view of a shroud 320 disposed around the sensor 330. In particular, sensor 330 (and each of the sensors of the array of sensors) may have sensing or detector ports such as detector ports 340. In at least one instance the shroud 320 may be a two-piece clam shell arrangement wherein one piece of the clam shell is secured to the other piece of the clam shell, thereby defining the chamber 322 operable to receive the sensor 330. The two-piece clam shell can be secured one piece to the other by fasteners, latch clips, or any engagement operable to provide sufficient sealing from environmental contamination.

The shroud 320 can be operable to cover the detector ports 340, thus preventing environmental contamination (e.g. sensing of fluid in the annulus 40). The shroud 320 may provide a chamber 322 in which at least a portion of the sensor 330 can be received and establish fluidic communication with the detector ports 340 via the snorkel line 315. In at least some instances, chamber 322 may additionally include an elastomeric material along an out edge to provide further protection against external fluids, such as those in the annulus.

Referring to FIGS. 3A-3F, the sensor 330 can be attached to a line 335 (e.g. a TEC). In at least one instance, the sensor 330 may be attached at the manufacturing level. The shroud 320 can be coupled with the sensor 330 at the manufacturing level and/or can be coupled with the sensor 330 on the rig floor. The shroud 320 can have a snorkel line 315—which may be approximately 5 to 25 ft. long, or alternatively about 15 ft. long, but can vary in length, and may be shorter or longer depending desired application and situational need. The snorkel line 315 refers to a fluidic tubular coupling providing fluidic communication between the chamber 322 and the tubular 300. The snorkel line 315 may be any flexible and/or semi-rigid tubing which permits the flow of a fluid therethrough. Accordingly, the snorkel line 315 may have an internal bore running along its length.

The snorkel line 315 may be coupled with the tubular 300 and/or connector 310 while on the rig floor prior to deploying the tubular string 22. The snorkel line 315 may also be made to couple with the shroud 320 if the connection is a field installable connection. Accordingly, the snorkel line 315 may have fittings and/or connections to fluidly couple with corresponding fittings or connections on the shroud 320. Such fittings or connections may include standard threads or may be orbital weld type connection or another method of joining. Accordingly, the snorkel line 315 may establish fluid communication with the connector 310, which in turn is in fluid communication with the collar port 385 which in turn has fluid communication with the sensor port 350, which extends to the central flow passage 360 of the tubular 300, thereby establishing fluid communication and/or other communication can be established to measure one or more properties of the internal fluid of the tubular 300.

The sensors 330 (and/or the shroud 320) can be attached in-line with the line (e.g. TEC). The shroud 320 may be sealed to the line above and/or below the sensor 330 (or sealed against the sensor 330 above the detector ports 340 of the sensor 330). The snorkel line 315 can be attached to the shroud 320 and can be attached via FMJ or other connector to the closest coupling collar 305 during install. The coupling of the snorkel line 315 to the connector 310 may be above and/or below the sensor 330.

The line 335 can be spooled with the one or more sensors 330 and/or with the sensors 330 operably received within the one or more shrouds 320. When spooled onto spool 105 as part of the array of sensors 100, the shroud 320 and the contained sensor 330 may need additional protection. A tubular protection sleeve with a central bore can be placed over the shroud 320, thereby providing protection to the shroud 320 and/or the sensor 330 when the line 335 is spooled either for transport to the wellsite or at the wellsite prior to being run into hole. A slit can be provided in the protection sleeve along the axial direction, thereby allowing the protection sleeve to wrap around the shroud 320 above and/or below it.

The snorkel line 315 may be communicatively coupled to the sensor 330, thus allowing the sensor 330 to measure one or more properties of fluid within the tubular 300 as coupled by the snorkel line. The snorkel line 315 can be welded to the sensor 330 and/or can be removably attached using a connector, fitting, and/or an attached sealed housing/fixture. The snorkel line 315 can be attached to either the sensor, the tubing coupler, both, or another piece of equipment.

Although collar 305 is shown in FIGS. 3A-C, the snorkel 315 need not be communicatively (e.g., fluidically) coupled via the collar and/or attached thereto. In at least one instance, a substitute tubular (which may be a pup joint) can be fitted with a sensor port 350 having a coupling end (such as a male or female end), where a coupling end of a connector (such as a female or male end) may couple to the coupling end. Accordingly, a collar 305 can be omitted without deviating from this disclosure, and the connector communicatively (fluidically) coupled directly to the tubular sensor port 350 without an intervening collar 305. In other instances, the connector can be coupled via a block welded onto the tubular (such as a pup joint), and/or machining an eccentric tubular with a block machined thereon. Therefore, the connector can be coupled directly to the tubular 300, a modified tubular or a tubular fitted via a collar.

Figure 3E:
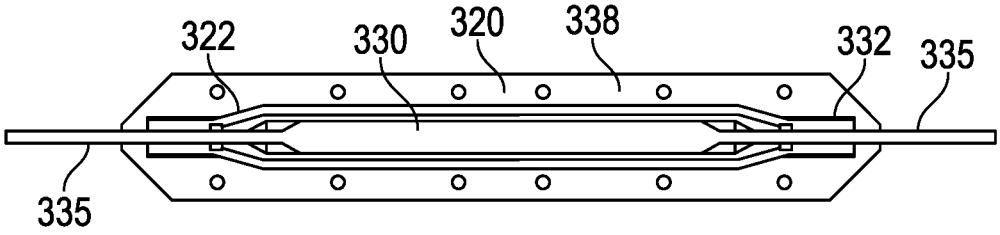
FIG. 3E is a partial planar view of a shroud and snorkel with an epoxy seal having a ported sensor received therein according to at least one instance of the present disclosure.

FIG. 3E illustrates a partial planar view of a shroud assembly having an epoxy sealant according to at least one instance of the present disclosure. The shroud 320 can have epoxy or resin disposed therein to provide a sealant within the shroud 320 to protect the sensor 330, snorkel 315, and/or other points of entry into the chamber 322 of the shroud 320. In at least one instance, the epoxy can be WellLock® resin. In other instances, the sealant can be any other epoxy operable to seal the shroud 320 and operable to operate in the anticipated downhole environment.

Figure 3F:
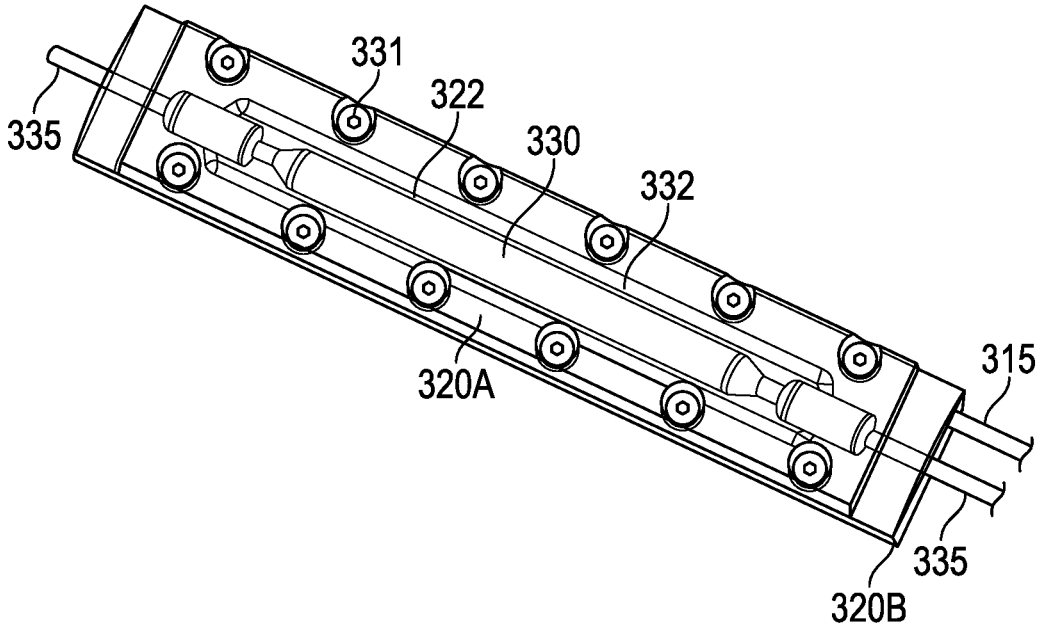
FIG. 3F is a isometric view of a shroud and snorkel with an epoxy seal having a ported sensor received therein according to at least one instance of the present disclosure.

FIG. 3F illustrates a diagrammatic isometric view of a shroud assembly having an elastomeric seal. The shroud 320 can include an elastomeric seal 332 operable to isolate the sensor 330 from adjacent environmental conditions while allowing the snorkel 315 to provide fluidic communication with the chamber 322. The shroud 320 can be a two-piece element 320A, 320B secured together by fasteners 331. For illustrative purposes FIG. 3F details piece 320A as clear. In at least one instance, the elastomeric seal 332 can be an O-ring. In some instances, the elastomeric seal 332 can be fitted within a grooved formed within a portion shroud 320. In other instances, the elastomeric seal 328 can be compressed during securement between the two-pieces 320A, 320B of the shroud 320, thereby sealing the shroud 320. In at least one instance, the elastomer can be split, thereby allowing the elastomer to be disposed around the control line. In some instances, the epoxy can be used to help prevent leakage through the split.

Figure 3G:
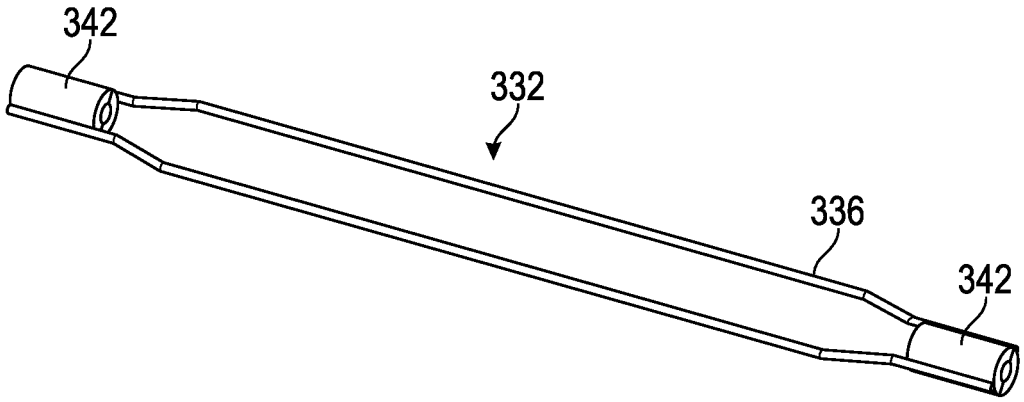
FIG. 3G is an isometric view of an elastomeric seal operable to be engaged with a shroud according to at least one instance of the present disclosure.

FIG. 3G illustrates an isometric view of an elastomeric seal 332 operable to be implemented within the shroud assembly 320. The elastomeric seal 332 be disposed around a perimeter 336 of the shroud assembly 320, thereby sealing the sensor 330, chamber 322, and/or sensor ports 340. The elastomeric seal 332 can be received within a groove 338 formed along at least a portion of the perimeter 336 of the shroud assembly 320.

In at least one instance, the elastomeric seal 332 can include at least one pipe seal 342 operable to allow the line 335 to be circumferentially surrounded by the elastomeric seal 332. As can be appreciated in further detail with respect to FIGS. 3H and 3I, the elastomeric seal 332 can be a two piece and/or split to receive the liner 335 through a portion of the pipe seal 342.

The elastomeric seal 332 can have a substantially thinner profile around the perimeter 336 relative to the at least one pipe seal 342. In at least one instance, the elastomeric seal 332 is an O-ring. In some instances, the elastomeric seal 332 can be coated with a silicone and/or other lubricant to prevent drying and/or cracking and thus leaking.

The elastomeric seal 332 can be compressed between adjacent portions of the shroud assembly 320, thereby forming a pressure seal. In some instances, the shroud assembly 320 can be a two-piece assembly secured together by one or more fasteners (e.g. screws, clamps, etc.), thus creating the pressure seal. In other instances, the shroud assembly 320 can single piece clam shell style assembly, wherein the elastomeric seal 332 is compressed within the clam shell.

Figure 3H:
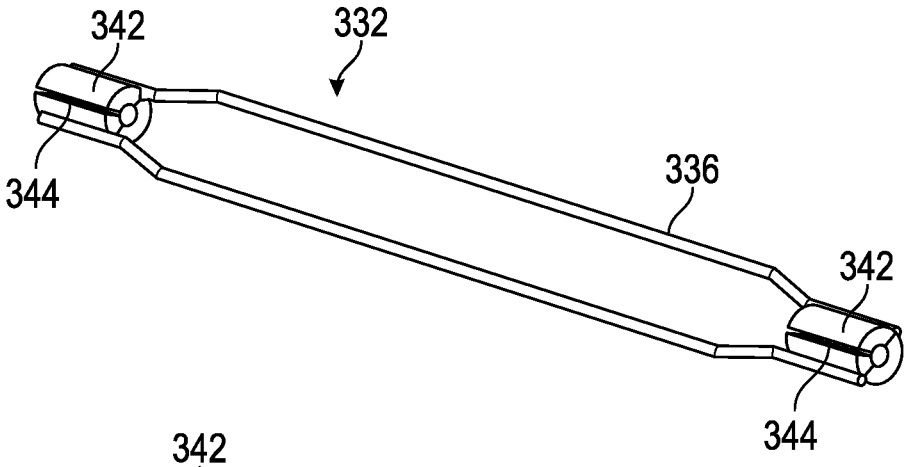
FIG. 3H is an isometric view of an elastomeric seal having a split therein and operable to be engaged with a should according to at least one instance of the present disclosure.

FIG. 3H illustrates a single piece elastomeric seal according to at least one instance of the present disclosure. The elastomeric seal 332 can have a split 344 formed within the at least one pipe seal 342. The split 344 can be formed longitudinally along the at least one pipe seal of the elastomeric seal 332, thereby allowing the line 335 and/or sensor 330 to be received into the at least one pipe seal 342.

The pipe seal 342 can be operably arranged to substantially surround the line 335 and/or sensor 330, thus providing a circumferential elastomeric seal around the line 335 and/or sensor 330.

The split 344 can be arranged and/or positioned on the at least one pipe seal 342 such that during compression of the shroud assembly 320, the split 344 is similarly compressed thus preventing leakage therethrough.

Figure 3I:
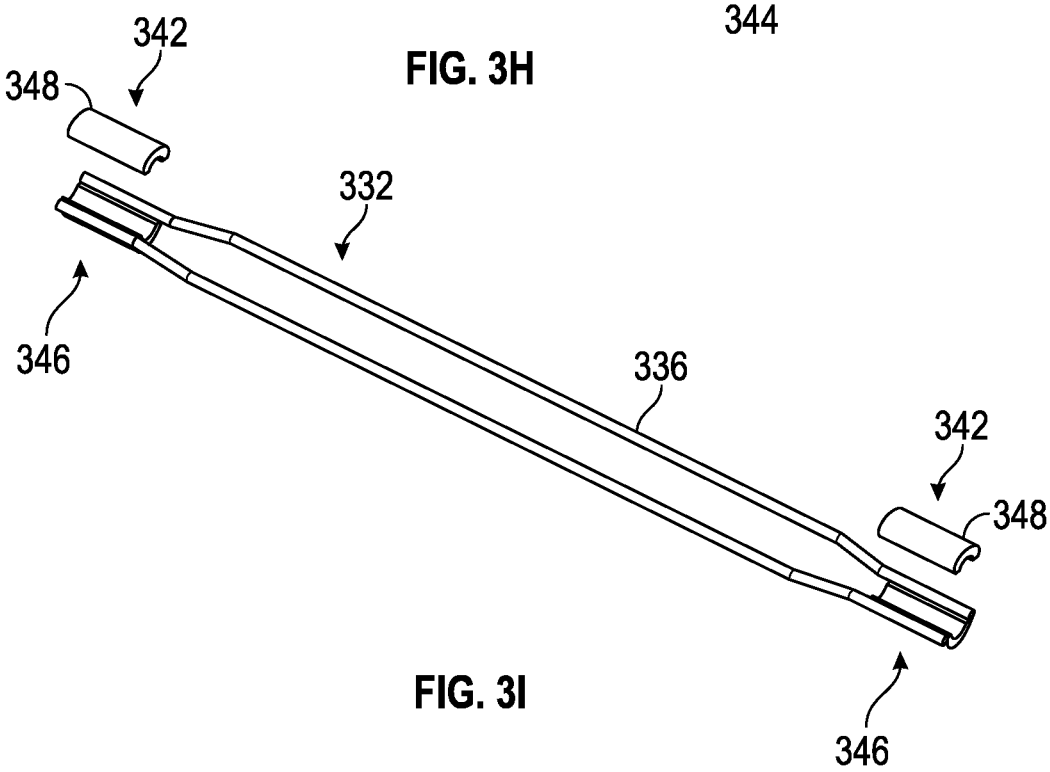
FIG. 3I exploded view of a two piece elastomeric seal operable to be engaged with a shroud according to at least one instance of the present disclosure.

FIG. 3I illustrates a multi-piece elastomeric seal according to at least one instance of the present disclosure. The elastomeric seal 332 can be formed by a plurality of pieces operably compressed together to form a seal around the perimeter 338 of the shroud assembly 320.

In at least one instance, the at least one pipe seal 342 can be a two-piece assembly having a bottom portion 346 formed as a portion of the elastomeric seal 332 and a top portion element 348 operable to engage with the bottom portion 346 and surround at least a portion of the line 335 and/or the sensor 330.

At least a portion of the line 335 and/or sensor 330 can be operably received within the bottom portion 346. The top portion 348 can then be aligned and engaged with the bottom portion 346, thereby circumferentially surrounding the at least a portion of the line and/or sensor 330.

The pipe seal 342 can be operably arranged to substantially surround the line 335 and/or sensor 330, thus providing a circumferential elastomeric seal around the line 335 and/or sensor 330. The two-piece assembly, bottom portion 346 and top portion 348, can be arranged and/or positioned the at least one pipe seal 342 such that during compression of the shroud assembly 320, the bottom portion 346 is similarly compressed into and engaged with the top portion 348, thus preventing leakage therethrough.

In at least one instance, the bottom portion 346 is substantially semi-circular and operable to circumferentially engage a half of the line 335 and/or sensor 330 while the top portion 348 is substantially semi-circular and operable to circumferentially engage the remaining half of the line 335 and/or sensor 330. In other instances, the bottom portion 346 and the top portion 348 can be substantially wedge shaped. The bottom portion 346 can circumferentially engage a fraction (e.g. a quarter, a third, two thirds, three quarters, etc.) of the line 335 and/or sensor 330 while the top portion 348 can circumferentially engage a remaining fraction of the line 335 and/or sensor 330.

As can be appreciated in FIGS. 3G-3I, the elastomeric seal 332 can include two pipe seals 324 longitudinally displaced along the length of the elastomeric seal 332. The elastomeric seal 332 can implement a split 344 and/or two-piece pipe seal 342. In at least one instance, one pipe seal 324 can implement a split 344 arrangement while the second pipe seal 324 can implement a two-piece pipe seal 342.

Figure 3J:
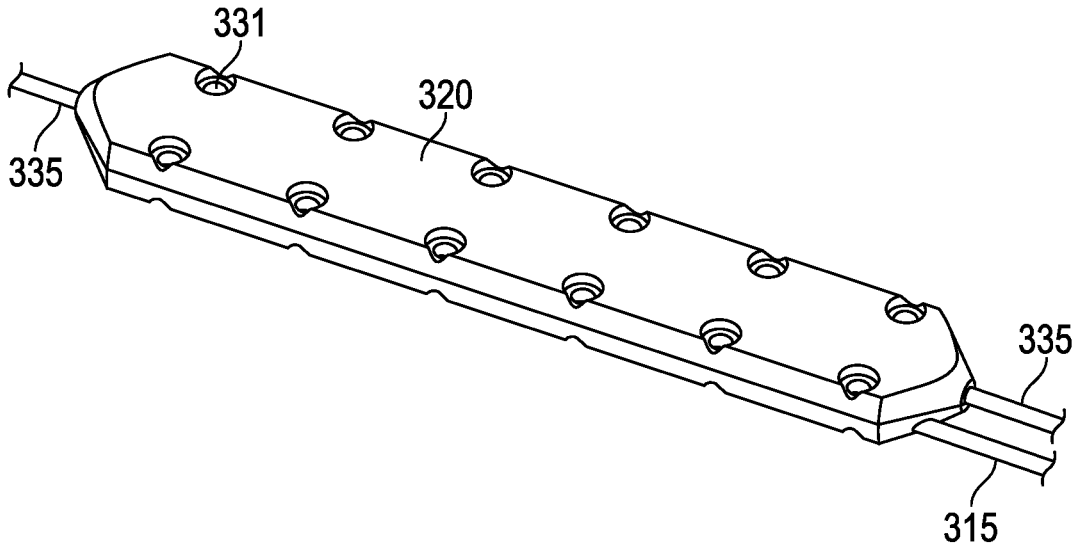
FIG. 3J is an isometric view of a shroud assembly having a snorkel and operable to receive a ported sensor therein according to at least one instance of the present disclosure.

FIG. 3J illustrates an isometric view of a shroud assembly 320 having a sensor 330 received therein. The shroud assembly 320 can be fastened and/or otherwise secured around the sensor 330, with the sensor 330 received within the chamber 322 formed on the interior of the shroud 320. While the present disclosure is drawn to a two-piece shroud assembly 320, it is within the scope of this disclosure to implement the shroud 320 with any number of pieces operable to collectively engage to isolate the sensor ports 340 from the adjacent environment. The shroud 320 can be received over the sensor 330 or a portion of the sensor 330 having the one or more sensor ports 340 formed thereon.

Figure 3K:
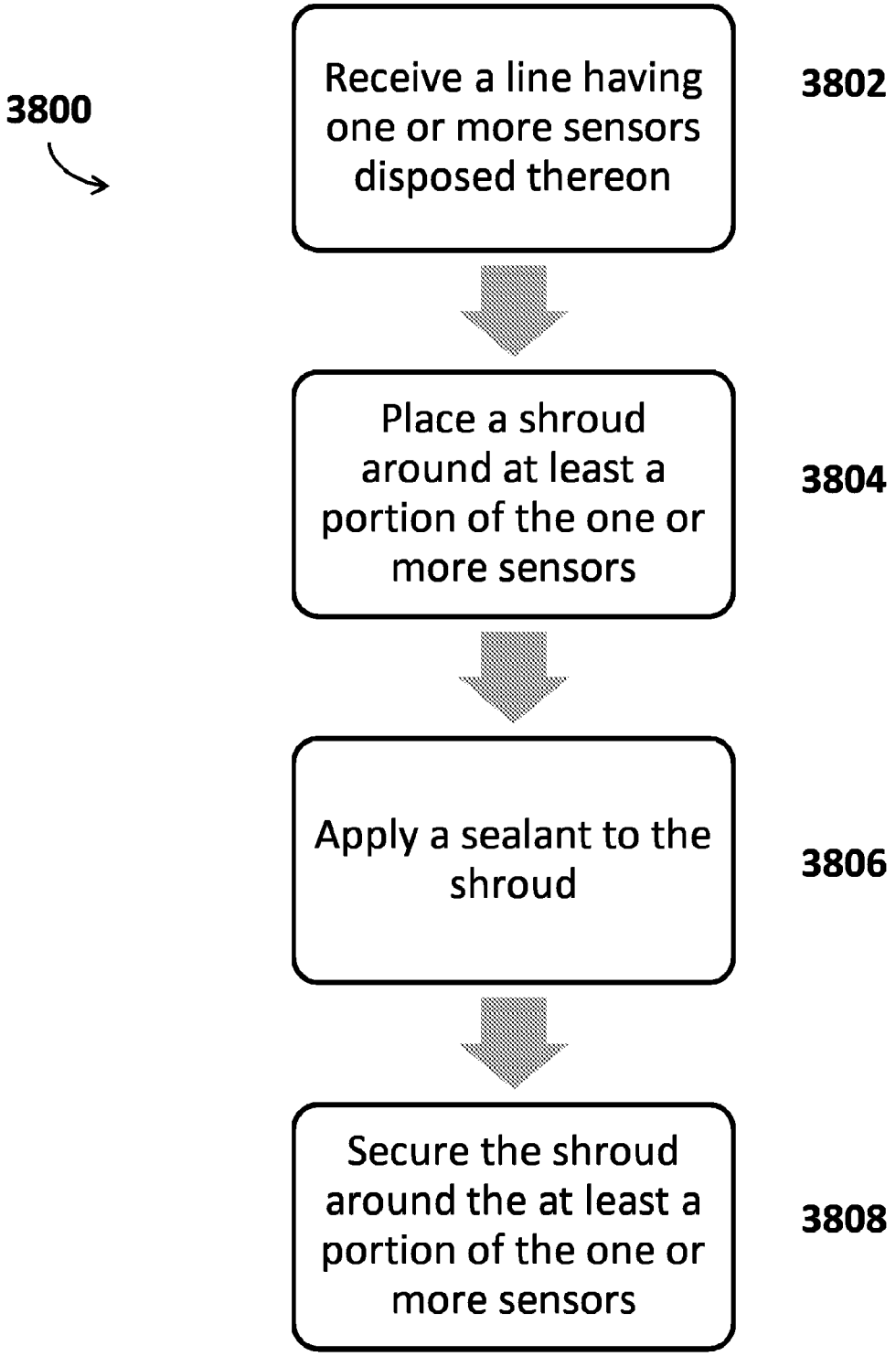
FIG. 3K is a method for sealing a shroud and snorkel ported sensor array according to at least one instance of the present disclosure.

FIG. 3K is a method of coupling a shroud around one or more sensors on a line having a sensor arrange. The one or more sensors disposed on the line (e.g. TEC) can be evenly distributed along the line and/or distributed at predetermined intervals, wherein the intervals vary along the length of the line. The method 3800 can be implement with respect to FIGS. 3A-3G, and while specific processes are described below no specific order is intended or implied. Further, additional processes, sub-processes, and/or methods can be implemented within method 3800 without deviating from this disclosure. The method 3800 can begin at block 3802.

At block 3802, a line 335 having one or more sensors 330 disposed thereon can be received. The one or more sensors 330 can have one or more ports 340 formed therein operable to measure one or more properties. The line 335 can be received in a spooled and/or unspooled arrangement. The method 3800 can then proceed to block 3804.

At block 3804, a shroud 320 can be placed around at least a portion of the one or more sensors 330. The shroud 320 can be operably disposed around at least the one or more ports 340 of each sensor 330. The shroud 320 can allow the line 335 to enter and/or exit while at least a portion of the sensor 330 is received therein. The shroud 320 can include a snorkel 315 providing fluidic communication between the sensor 330 and an environment to be measured. The method 3800 can be proceed to block 3806.

At block 3806, a sealant can be applied to the shroud 320. The sealant can be applied to a portion of the shroud 320 operable to engage with another portion of the shroud 320, thereby isolating the sensor 330 form the adjacent environment. The sealant can be an epoxy (e.g. WellLock® resin), an elastomer seal, and/or a swell rubber. In at least one instance, the sealant can be applied to the shroud 320 prior to receiving at least a portion of the sensor 330. In other instance, the sealant can be applied to the shroud 320 after receiving at least a portion of the sensor 330 therein. The sealant can be applied to isolate at least a portion of sensor from an adjacent environment via the shroud 320 and can be operable to seal around the line 335 and/or the snorkel 315. The method 3800 can then proceed to block 3808.

At block 3808, the shroud can be secured around the sensor 330, thereby forming an environmental seal around the one or more sensor ports 340. The shroud 320 can be a two piece clamping arrangement having a first piece is secured to a second piece, thereby defining a chamber 322 in which the sensor 330 is received. The securement of the first shroud piece to the second shroud piece can be by fastener, clamping arrangement, or other securement mechanism. The secured shroud 320 can be seal the sensor 330 from adjacent environment in combination with the sealant.

After securement of the shroud 320 around the one or more sensors 330 on the line 335, the line can be spooled and/or run into hole. The line 335 can be spooled for transportation to and/or storage at the well site. In other instances, the shroud 320 can be secured around the one or more sensors 330 and then run into hole.

Spooling and handling the snorkel could be accomplished by winding the snorkel (for instance a control line which may be ⅛ inch, or alternatively from 1/16 inch to 1 inch, alternatively from ⅛ inch to ½ inch) around a bobbin (reel or spool) that is coaxial, or otherwise, with the shroud 320, or other housing, for the sensor. FIG. 3I is a schematic diagram of a reel 317 provided upon which the snorkel line 315 can be wound. At installation, this snorkel line could be un-spooled and terminated, without the need to be cut, as additional line could be left in place on the bobbin. Alternately, the bobbin and snorkel line could be attached to the coupling, and terminated to the sensor at installation. This would allow the line to be welded, or otherwise permanently attached to the coupling to minimize the eccentricity of the coupling.

Figure 4:
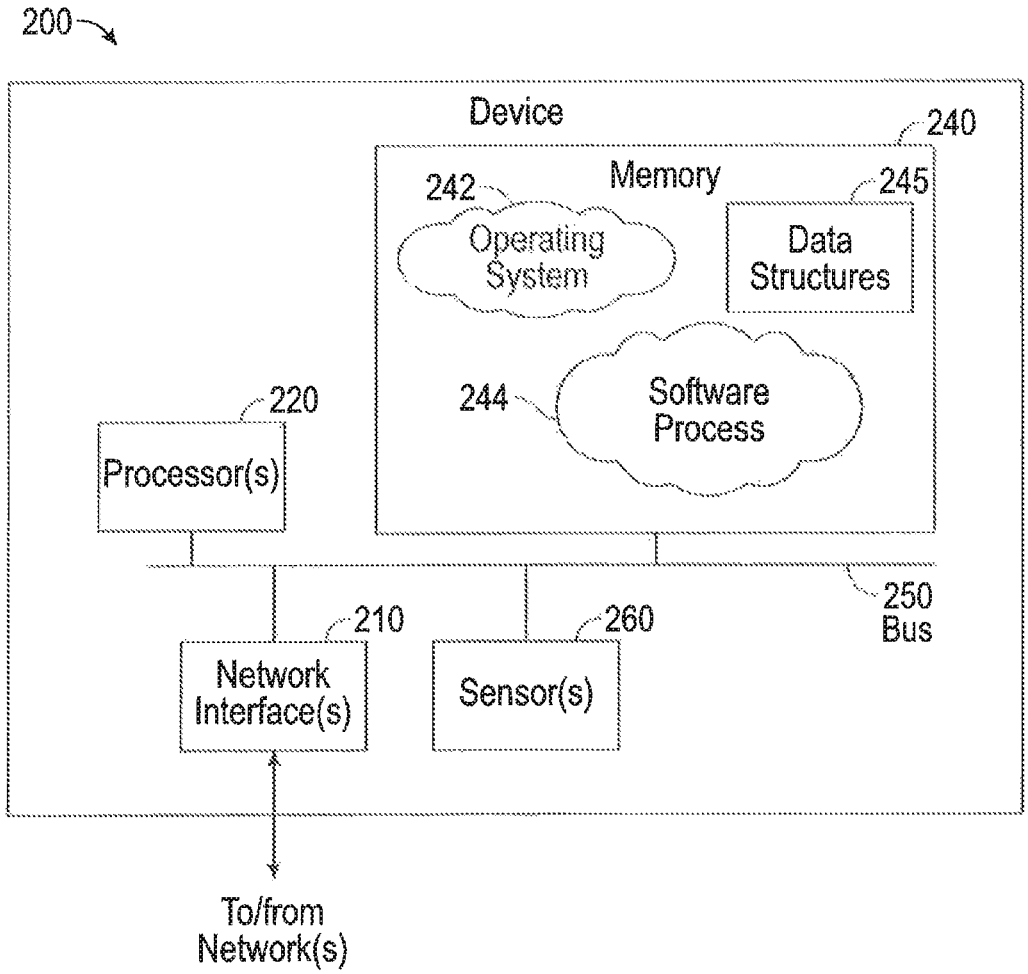
FIG. 4 is a schematic diagram of a processing device which may be employed with the disclosure herein.

FIG. 4 is a block diagram of an exemplary device 200. Device 200 is configured to perform processing of data and communicate with the sensors 101 of the array of sensors 100. In operation, device 200 communicates with one or more of the above-discussed borehole components and may also be configured to communication with remote devices/systems.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communication links, which may include wired or wireless communication links. Network interfaces 210 are configured to transmit and/or receive data using a variety of different communication protocols, as will be understood by those skilled in the art.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260, which may include the sensors 101 of the array of sensors 100 as disclosed herein, typically operate in conjunction with processor 220 to perform wellbore measurements, and can include special-purpose processors, detectors, transmitters, receivers, and the like. In this fashion, sensors 260 may include hardware/software for generating, transmitting, receiving, detection, logging, and/or sampling magnetic fields, seismic activity, and/or acoustic waves, or other well parameters.

Memory 240 comprises a plurality of storage locations that are addressable by processor 220 for storing software programs and data structures 245 associated with the instances described herein. An operating system 242, portions of which are typically resident in memory 240 and executed by processor 220, functionally organizes the device by, inter alia, invoking operations in support of software processes and/or services 244 executing on device 200. These software processes and/or services 244 may perform processing of data and communication with device 200, as described herein. Note that while process/service 244 is shown in centralized memory 240, some instances provide for these processes/services to be operated in a distributed computing network.

It will be apparent to those skilled in the art that other processor and memory types, including various computer-readable media, may be used to store and execute program instructions pertaining to the borehole evaluation techniques described herein. Also, while the description illustrates various processes, it is expressly contemplated that various processes may be embodied as modules having portions of the process/service 244 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

The instances shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the instances described above can be modified within the scope of the present disclosure.

STATEMENT OF THE CLAIMS

Statement 1: A method comprising receiving a line having one or more sensors installed thereon, the one or more sensors having one or more ports formed therein, the one or more ports operable to measure one or more properties; placing at least a portion of a shroud over at least a portion of the one or more sensors disposed on the line, wherein the shroud has a chamber formed therein operable to receive at least a portion of the sensor; applying a sealant to the shroud; securing the shroud around at least a portion of the sensors, wherein the shroud isolates at least a portion of the shroud from an adjacent environment.

Statement 2: The method of Statement 1, wherein the line is received on a spool and further comprising unspooling the line prior to placing at least a portion of the shroud.

Statement 3: The method of Statement 1 or Statement 2, further comprising spooling the line having the shroud installed over at least a portion of the sensor.

Statement 4: The method of any one of Statements 1 to 3, further comprising running the line having the shroud installed over at least a portion of the sensor downhole.

Statement 5: The method of any one of Statements 1 to 4, wherein the sealant is an elastomeric material.

Statement 6: The method of any one of Statements 1 to 5, wherein the elastomeric material has a split along a longitudinal length, and the line is operable to be received within the split and an epoxy resin is disposed along the split.

Statement 7: The method of any one of Statements 1 to 6, wherein the sealant is an epoxy resin.

Statement 8: The method of any one of Statements 1 to 7, wherein the sealant is a swellable rubber.

Statement 9: The method of any one of Statements 1 to 8, wherein the shroud is a two-piece shroud, a first piece of the shroud coupled with the other piece of the shroud by a plurality of fasteners, the plurality of fasteners providing a predetermined coupling force, thereby compressing the sealant.

Statement 10: The method of any one of Statements 1 to 9, wherein, the shroud includes a snorkel operable to establish fluid communication to the chamber.

Statement 11: The method of any one of Statements 1 to 10, wherein the shroud is formed from a semi-rigid material.

Statement 12: A system comprising a line having a plurality of sensors installed thereon, each sensor having one or more detector ports formed therein, the plurality of sensors serially arranged on the line; a tubular string extending along a borehole formed in a subterranean formation, the tubular string having a plurality of connectors disposed thereon, the connectors operably engaged with a sensor port formed in the tubular string exposing an inner bore of the tubular string; a shroud disposed over at least a portion of each sensor of the plurality of sensors, the shroud having a chamber operable to receive at least a portion of the sensor; a snorkel line is operably engaged with a connector of the plurality of connectors and a shroud, thereby providing fluidic communication between the tubular string and the chamber.

Statement 13: The system of Statement 12, wherein the shroud is a two-piece shroud formed over the sensor, a first piece of the shroud coupled with the other piece by a plurality of fasteners.

Statement 14: The system of Statement 12 or Statement 13, wherein the shroud has a sealant received therein operable to isolate the sensor from adjacent environmental conditions.

Statement 15: The system of any one of Statements 12 to 14, wherein the sealant is an elastomeric material.

Statement 16: The system of any one of Statements 12 to 15, wherein the sealant is an epoxy resin.

Statement 17: The system of any one of Statements 12 to 16, wherein the sealant is a swellable rubber.

Statement 18: The system of any one of Statements 12 to 17, wherein the tubular string has a collar coupled therewith, the collar having the connector coupled therewith and operably engaged with the sensor port.

Statement 19: The system of any one of Statements 12 to 18, wherein the elastomeric material has a split along a longitudinal length, and the line is operable to be received within the split.

Statement 20: The system of any one of Statements 12 to 19, wherein an epoxy resin is disposed along the split.

The invention claimed is:

1. A method comprising:

receiving a line having one or more sensors installed thereon, the one or more sensors having one or more detector ports formed therein, the one or more detector ports operable to measure one or more fluid properties channeled from a tubular string, wherein the tubular string is coupled with a collar, the collar having an aperture to receive at least a portion of the tubular string, and wherein the collar having at least one connector coupled therewith and operably engaged with the one or more sensor ports;

placing at least a portion of a shroud over at least a portion of the one or more sensors disposed on the line, wherein the shroud has a chamber formed therein operable to receive at least a portion of the one or more sensors;

sealing the shroud; and securing the shroud around at least a portion of the one or more sensors, wherein the shroud isolates at least a portion of the shroud from an adjacent environment.

2. The method of claim 1, wherein the line is received on a spool and further comprising unspooling the line prior to placing at least a portion of the shroud.

3. The method of claim 1, further comprising spooling the line having the shroud installed over at least a portion of the one or more sensors.

4. The method of claim 1, further comprising running the line having the shroud installed over at least a portion of the one or more sensors downhole.

5. The method of claim 1, wherein the seal is an elastomeric material.

6. The method of claim 5, wherein the elastomeric material has a split along a longitudinal length, and the line is operable to be received within the split and an epoxy resin is disposed along the split.

7. The method of claim 1, wherein the seal is an epoxy resin.

8. The method of claim 1, wherein the seal is a swellable rubber.

9. The method of claim 1, wherein the shroud is a two-piece shroud, a first piece of the shroud coupled with a second piece of the shroud by a plurality of fasteners, the plurality of fasteners providing a predetermined coupling force, thereby compressing the seal within the shroud.

10. The method of claim 1, wherein, the shroud includes a snorkel operable to establish fluid communication to the chamber.

11. The method of claim 1, wherein the shroud is formed from a semi-rigid material.

12. A system comprising:

a line having a plurality of sensors installed thereon, each sensor having one or more detector ports formed therein, the plurality of sensors serially arranged on the line;

a tubular string extending along a borehole formed in a subterranean formation, wherein the tubular string having a plurality of connectors disposed thereon, the connectors operably engaged with a sensor port formed in the tubular string exposing an inner bore of the tubular string, and wherein the tubular string is coupled with a collar, the collar having an aperture to receive at least a portion of the tubular string, and wherein the collar having at least one connector coupled therewith and operably engaged with the one or more sensor ports;

a shroud disposed over at least a portion of each sensor of the plurality of sensors, the shroud having a chamber operable to receive at least a portion of the sensor; and a snorkel line is operably engaged with a connector of the plurality of connectors and the shroud, thereby providing fluidic communication between the tubular string and the chamber of the shroud.

13. The system of claim 12, wherein the shroud is a two-piece shroud formed over the each sensor, a first piece of the shroud coupled with a second piece of the shroud by a plurality of fasteners.

14. The system of claim 13, wherein the plurality of fasteners provides a predetermined coupling force, thereby compressing a seal within the shroud and isolating the sensor from adjacent environmental conditions.

15. The system of claim 12, wherein the shroud has a seal received therein operable to isolate the each sensor from adjacent environmental conditions.

16. The system of claim 15, wherein the seal is an elastomeric material.

17. The system of claim 16, wherein the elastomeric material has a split along a longitudinal length, and the line is operable to be received within the split.

18. The system of claim 17, wherein an epoxy resin is disposed along the split.

19. The system of claim 15, wherein the seal is an epoxy resin.

20. The system of claim 15, wherein the seal is a swellable rubber.

* * * * *